United States Patent [19]

Fukuroi et al.

[11] Patent Number: 4,625,370

[45] Date of Patent: Dec. 2, 1986

[54] HOOK-AND-EYE ASSEMBLY

[75] Inventors: Takeo Fukuroi; Kihei Takahashi; Keichi Inazawa, all of Uozu, Japan

[73] Assignee: Yoshida Kogyo K. K., Tokyo, Japan

[21] Appl. No.: 809,723

[22] Filed: Dec. 17, 1985

[30] Foreign Application Priority Data

Dec. 17, 1984 [JP] Japan ..... 59-191114[U]
Jan. 22, 1985 [JP] Japan ..... 60-7097[U]

[51] Int. Cl.[4] ..... A44B 13/00; A44B 1/42

[52] U.S. Cl. ..... 24/599; 24/90 R; 24/90 C; 24/621

[58] Field of Search ..... 24/599, 621, 623, 90 R, 24/90 C, 94, 108, 681, 691

[56] References Cited

U.S. PATENT DOCUMENTS

| | | | |
|---|---|---|---|
| 496,155 | 4/1893 | Hall | 24/94 |
| 511,482 | 12/1893 | Williams | 24/623 |
| 1,784,389 | 12/1930 | Reiter | 24/623 |
| 1,808,535 | 6/1931 | Erwin | 24/90 R |
| 2,668,340 | 2/1954 | Jones | 24/681 |
| 3,016,593 | 1/1962 | Rowles | 24/599 |
| 3,613,181 | 10/1971 | Taylor | 24/691 |

FOREIGN PATENT DOCUMENTS

| | | | |
|---|---|---|---|
| 3312974 | 10/1984 | Fed. Rep. of Germany | 24/90 R |
| 53-28567 | 7/1978 | Japan . | |
| 58-6152 | 7/1984 | Japan . | |
| 1014390 | 12/1965 | United Kingdom . | |

*Primary Examiner*—Victor N. Sakran
*Attorney, Agent, or Firm*—Hill, Van Santen, Steadman & Simpson

[57] ABSTRACT

A hook-and-eye assembly includes an eye attached by a first fastener to a first fabric (FA), and a hook attached by a second fastener to a second fabric (FB). The eye has a base plate having a pair of arms projecting laterally from one surface of the base plate and defining an opening therewith, the base plate having a first embossed portion projecting away from the arms and having a center spaced from edges of the arms, the first embossed portion having a pair of first holes divided by a first bridge. The first fastener has a pair of first prongs inserted through the first holes, respectively, and bent around the first bridge with the first embossed portion directed toward the first fastener for positioning the first fabric (FA) therebetween. The hook includes a face plate for insertion into the opening and a back plate spaced therefrom, the back plate having a second embossed portion projecting away from the face plate and having a pair of second holes divided by a second bridge. The second fastener has a pair of second prongs inserted through the second holes, respectively, and bent around the second bridge with the second embossed portion directed toward the second fastener for positioning the second fabric (FB) therebetween.

10 Claims, 16 Drawing Figures

HOOK-AND-EYE ASSEMBLY

BACKGROUND OF THE INVENTION

1. Field of the Invention

The present invention relates to a hook-and-eye assembly composed of a hook and an eye each attachable to a fabric by means of a fastener having two rivetable prongs.

2. Description of the Prior Art

Hook-and-eye assemblies of metal are composed of a hook and an eye which are attached to fabric materials by means of prongs integral therewith. One such hook-and-eye assembly is disclosed in Japanese Utility Model Publication No. 53-28567 published on July 18, 1978. The disclosed hook is of a U shape composed of spaced face and back plates, the face plate having a pressed ridge projecting toward the back plate for engaging the eye to guard against accidental separation of the hook-and-eye assembly.

With the disclosed arrangement, however, only one ridge is formed on the face plate and cannot stably retain the eye in engagement with the hook. More specifically, there are sometimes employed two hook-and-eye assemblies on one piece of garment such as ski pants. When the user attempts to couple one hook-and-eye assembly after the other hook-and-eye assembly has been connected, the other joined hook-and-eye assembly tends to be disengaged due to a force applied by the user to assemble said one hook-and-eye assembly.

Another known hook-and-eye assembly is composed of a hook and an eye which are attached to garment fabrics by means of independent fasteners, respectively, having eyelets or prongs. This hook-and-eye structure has found wider use since it is more easier to manufature than those which have integral fasteners, and the hook and the eye can be made of an inexpensive metal such as iron. The hook-and-eye assembly with the eyelet fasteners is revealed in Japanese Design Registration No. 586152-Similar Design 1. The hook-and-eye assembly with two-prong fasteners is disclosed in British Patent No. 1014390.

The hook-and-eye assembly with the eyelet fasteners is disadvantageous in that since the eyelet fasteners are cylindrical, the hook and the eye are liable to turn with respect to the fasteners and fabrics, and the cylindrical eyelet fasteners when they pierce the fabrics pull fabric threads to cut them off or cause the fabrics to wrinkle. When staking the eyelet fasteners on the hook and the eye, the distal ends of the eyelet fasteners are forcibly spread radiall outwardly and pressed against the hook and the eye. If the distal ends of the eyelet fasteners were pressed with a weak force, the hook and the eye would be turned easily under a small force. If the eyelet fasteners were pressed with too a strong force, they would damage the fabrics. Since the eyelet fasteners as they are fastened form holes in the fabrics, any subsequence eyelet fastener which may be attached as a replacement must be carefully positioned in alignment with the hole which has been formed in the fabric by the preceeding eyelet fastener. Another shortcoming is as follows: When the eye and the hook are coupled together, the portion of the eye which engages the hook is substantially aligned with the center of a hole in the eye in which the eyelet fastener is inserted. A lateral pull applied to the engaging portion of the eye acts to turn the eye with respect the eyelet and hence the fabric, with the consequence that the radially outwardly curled distal end of the eyelet fastener will tend to be raised out of fastening engagement with the eye.

The two-prong fasteners each have two tapered prongs which are pressed to attach the hook or eye to the fabric. If the force imposed to stake the fastener were too small, the attached fastener would wobble in use. Additionally, it has been tedious and time-consuming to assemble the eye and its two-prong fastener together.

SUMMARY OF THE INVENTION

It is an object of the present invention to provide a hook-and-eye assembly having a hook and an eye which are prevented from turning with respect to their fasteners and fabrics.

Another object of the present invention is to provide a hook-and-eye assembly which can be attached to fabrics without wrinkling or damaging them.

Still another object of the present invention is to provide a hook-and-eye assembly composed of a hook and an eye which, when coupled together, are prevented from being turned with respect to each other under a pulling force applied thereto.

A still further object of the present invention is to provide a hook-and-eye assembly which can easily be assembled.

Still another object of the present invention is to provide a hook-and-eye assembly having a hook and an eye which can smoothly be connected and disconnected.

A still further object of the present invention is to provide a hook-and-eye assembly having a hook and an eye which will remain securely and stably coupled together to guard against accidental detachment prior to the application of an intentional manual force to separate the hook and the eye.

According to the present invention, there is provided a hook-and-eye assembly composed of an eye attached by a first fastener to a first fabric, and a hook attached by a second fastener to a second fabric. The eye has a base plate having a pair of arms projecting laterally from one surface of the base plate and defining an opening therewith, the base plate having a first embossed portion projecting away from the arms and having a center spaced from edges of the arms, the first embossed portion having a pair of first holes divided by a first bridge. The first fastener has a pair of first prongs inserted through the first holes, respectively, and bent around the first bridge with the first embossed portion directed toward the first fastener for positioning the first fabric therebetween. The hook includes a face plate for insertion into the opening of the eye and a back plate spaced therefrom, the back plate having a second embossed portion projecting away from the face plate and having a pair of second holes divided by a second bridge. The second fastener has a pair of second prongs inserted through the second holes, respectively, and bent around the second bridge with the second embossed portion directed toward the second fastener for positioning the second fabric therebetween.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Like or corresponding parts are denoted by like or corresponding reference charaters throughout several views.

Figure 1:
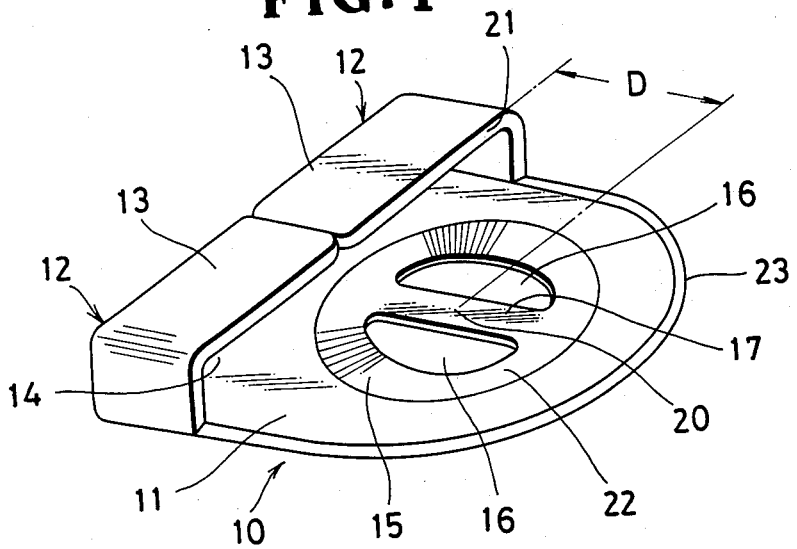
FIG. 1 is a perspective view of an eye according to the present invention.
Figure 2:
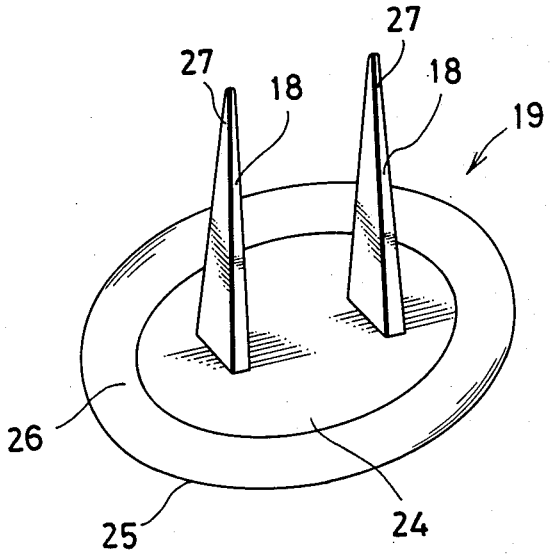
FIG. 2 is a perspective view of a fastener for attaching the eye shown in FIG. 1 to a fabric.
Figure 3:
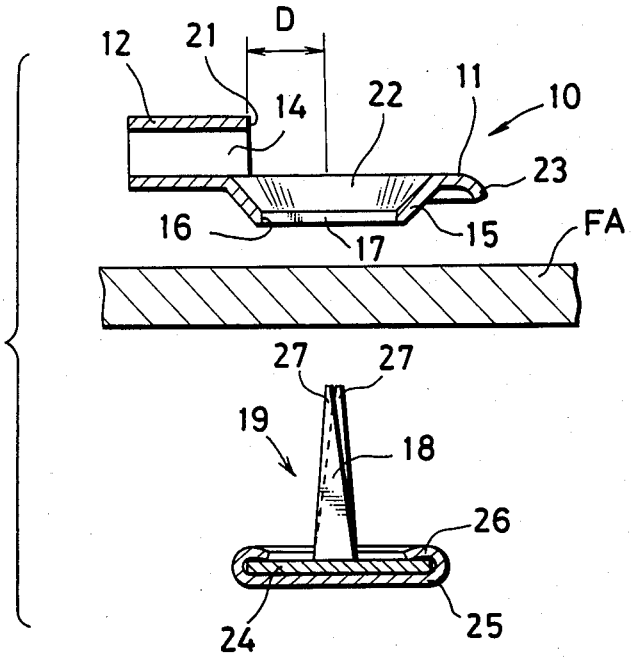
FIG. 3 is a cross-sectional view of the eye and the fastener of FIGS. 1 and 2, prior to their being coupled together on a fabric.
Figure 4:
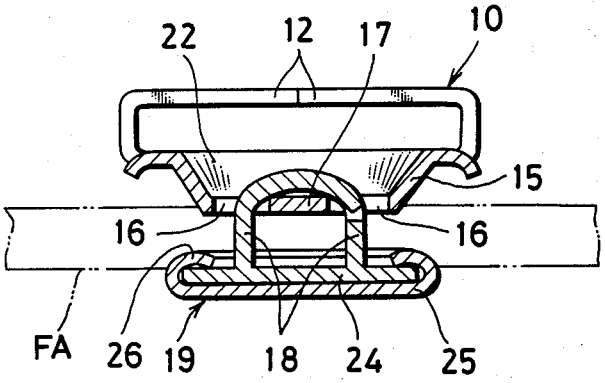
FIG. 4 is a cross-sectional view of the eye and the fastener of FIGS. 1 and 2, as they are fixedly assembled on the fabric.

FIGS. 1, 3 and 4 show an eye, generally designated by 10, of a hook-and-eye assembly according to the present invention. The eye 10 is composed of a base plate 11 including a pair of integral arms 12, 12 disposed on one end thereof and projecting laterally from one side or face thereof, the arms 12, 12 having flat portions 13, 13 lying flush with each other with their distal ends abutting against each other. The flat portions 13, 13 and the base plate 11 jointly define an opening 14 for insertion therein of the face plate or bill of a hook (described later on). The base plate 11 also has a circular embossed portion 15 formed on a back thereof as by pressing and spaced transversely from the arms 12, 12, the embossed portion 15 projecting in a direction away from the arms 12, 12. The embossed portion 15 has a pair of holes 16, 16 divided by a central bridge 17 for receiving therein the prongs 18, 18, respectively, of a fastener 19 (FIG. 2). The circular embossed portion 15 has a center 20 spaced a distance D from aligned edges 21 of the flat portions 13, 13 of the arms 12, 12. The embossed portion 15 is raised from the base plate 11 by a depth larger than the thickness of each of the prongs 18, 18, as best shown in FIG. 4, the embossed portion 15 defining a frustoconical recess 22 flaring toward the face of the base plate 11 on which the arms 12 are disposed. The recess 22 is receptive of the prongs 18, 18 when they are inserted through the holes 16, 16 and then staked in the recess 22 around the bridge 17. As shown in FIGS. 1 and 3, the base plate 11 has a semicicular peripheral edge 23 bent away from the face thereof.

As illustrated in FIGS. 2 through 4, the fastener 19 comprises a disc 24 from which the prongs 18, 18 project in spaced relation, and a circular cap 25 having a circumferential edge 26 staked around and over the circumferential edge of the disc 24. Each of the prongs 18, 18 is of a substantially triangular shape having a tapered end 27. As shown in FIG. 3, the tapered ends 27, 27 are slightly staggered from each other so that the prongs 18, 18 are positioned out of alignment when they are bent over the bridge 17 of the eye 10. The prongs 18, 18 are spaced from each other by a distance which is the same as the distance by which the holes 16, 16 in the eye 10 are spaced from each other.

For attaching the eye 10 to a fabric FA (FIGS. 3 and 4), the eye 10 is placed over the fabric FA with the embossed portion 15 facing the fabric FA, and the fastener 19 is disposed below the fabric FA with the prongs 18, 18 directed toward the fabric FA. Then, the eye 10 and the fastener 19 are pressed toward each other by a press or the like to cause the tapered ends 27, 27 of the prongs 18, 18 to penerate the fabric FA and then be inserted through the holes 16, 16, respectively. Then, the prongs 18, 18 are bent inwardly along each other over and around the bridge 17 partially into the opposite holes 16, 16 to join the eye 10 firmly to the fastener 19 with the fabric FA interposed therebetween, as illustrated in FIG. 4.

The fastener 19 is securely staked on the eye 10 since the prongs 18, 18 are deformed against the bridge 17. The pointed prongs 18, 18 are not liable to pull or cut off threads of the fabric FA as the prongs 18, 18 pierce the fabric FA, with the result that the fabric FA will remain intact against wrinkling or damage. The bent prongs 18, 18 are neatly accommodated in the recess 22 so that they do not project beyond the base plate 11 of the eye 10 and hence do not interfere with engagement and disengagement of the eye 10 with and from a hook (described later on). Inasmuch as the eye 10 is fixed to the fabric FA by the two prongs 18, 18, the eye 10 will not turn with respect to the fastener 19 and the fabric FA. As the center 20 of the embossed portion 15 positioned between the holes 16, 16 is spaced the distance D from the edges 21 of the flat portions 13, 13 of the arms 12, 12, the eye 10 will not be subject to a force tending to turn the eye 10 about the edges 21, but the base plate 11 will be pulled in a lateral direction only, when the eye 10 and the hook are pulled apart in engagement with each other. The eye 10 which is a single integral component is not required to be preassembled and can easily be attached to the fabric FA simply by staking the fastener 19 on the eye 10 as by pressing. The eye 10 and the fastener 19 can be manufactured inexpensively by making the eye 10 of an inexpensive metal such as iron and the fastener of an unoxidizable metallic material such as brass. Where the eye 10 and the fastener 19 are made of these materials, the prongs 18, 18 are not cracked when staked, and are not oxidized and remain sightly even if a plated layer comes off the prongs 18, 18.

Figure 5:
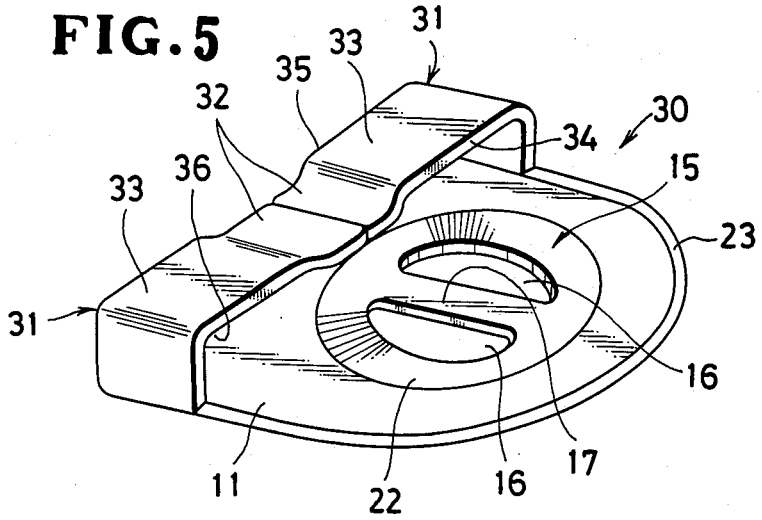
FIG. 5 is a perspective view of a modified eye.
Figure 6:
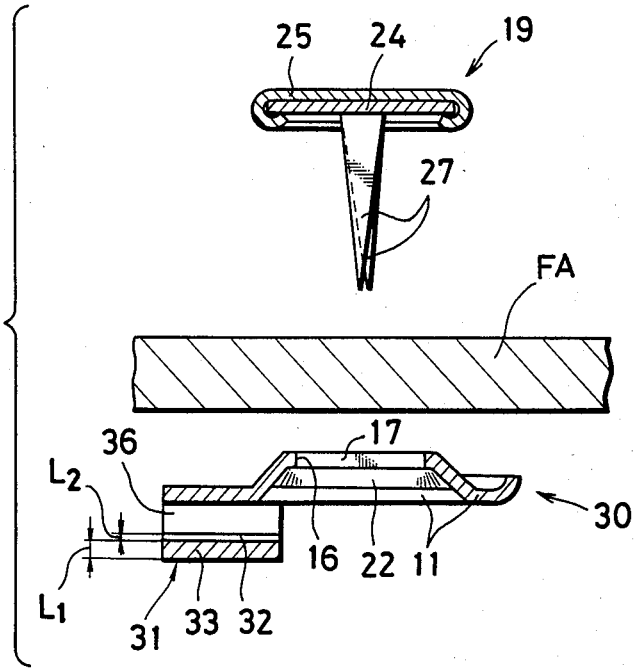
FIG. 6 is a cross-sectional view of the eye of FIG. 5, prior to its being attached to a fabric by a fastener.

FIGS. 5 and 6 illustrate a modified eye 30 according to the present invention. The eye 30 differs from the eye 10 of FIG. 1 in that the eye 30 has a pair of arms 31, 31 including pressed portions 32, 32, respectively, transversely displaced from the ends of flat portions 33, 33 thereof toward the base plate 11, the pressed portions 32, 32 being held in abutment against each other and disposed substantially centrally of the base plate 11 in its transverse direction. The pressed portions 32, 32 extend from one edge 34 to the other edge 35 of the respective flat portions 33, 33 of the arms 31, 31. Each of the arms 31, 31 has a thickness $L_1$ larger than the distance or interval $L_2$ by which one of the pressed portions 32, 32 is transversely displaced from the corresponding flat portion 33. The arms 31, 31 and the base plate 11 jointly define an opening 36 therebetween.

Figure 7:
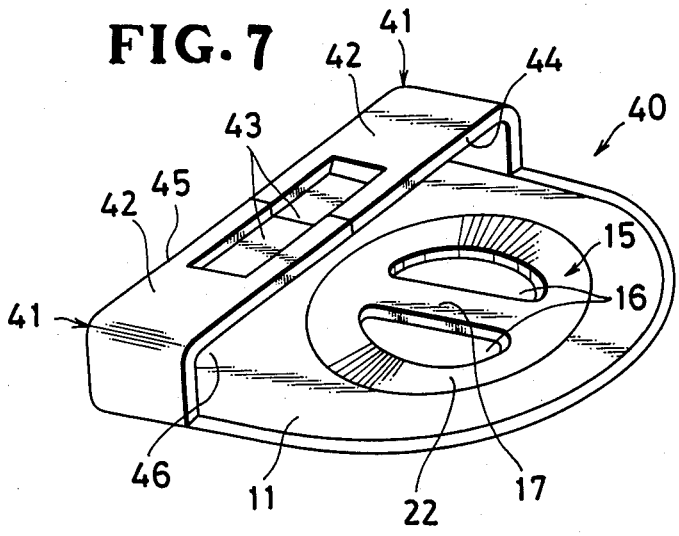
FIG. 7 is a perspective view of another modified eye.
Figure 8:
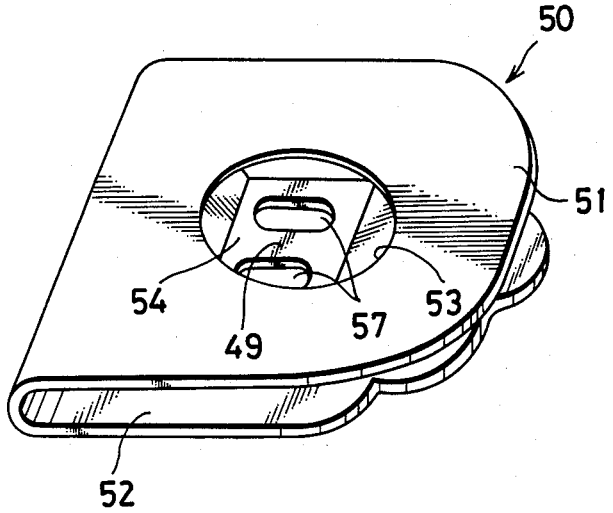
FIG. 8 is a perspective view of a hook according to the present invention, with a face plate directed upwardly.
Figure 9:
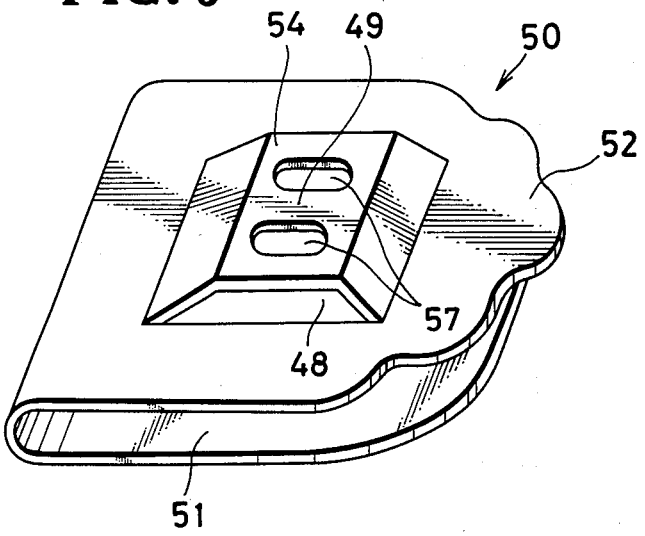
FIG. 9 is a perspective view of the hook of FIG. 8, with a back plate directed upwardly.

FIG. 7 shows another modified eye 40 according to the present invention. The eye 40 includes a pair of arms 41, 41 having flat portions 42, 42, respectively, having pressed portions 43, 43 on confronting ends thereof substantially centrally of the base plate 11. Each of the pressed portions 43, 43 is positioned laterally centrally between and terminates short of the opposite edges 44, 45 of one of the flat portions 42, 42 of the arms 41, 41. The arms 41, 41 and the base plate 11 jointly define an opening 46 therebetween.

Figure 10:
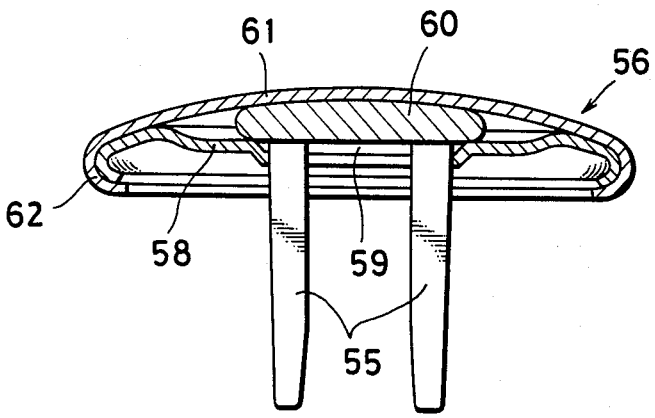
FIG. 10 is a cross-sectional view of a fastener for attaching the hook of FIGS. 8 and 9 to a fabric.
Figure 11:
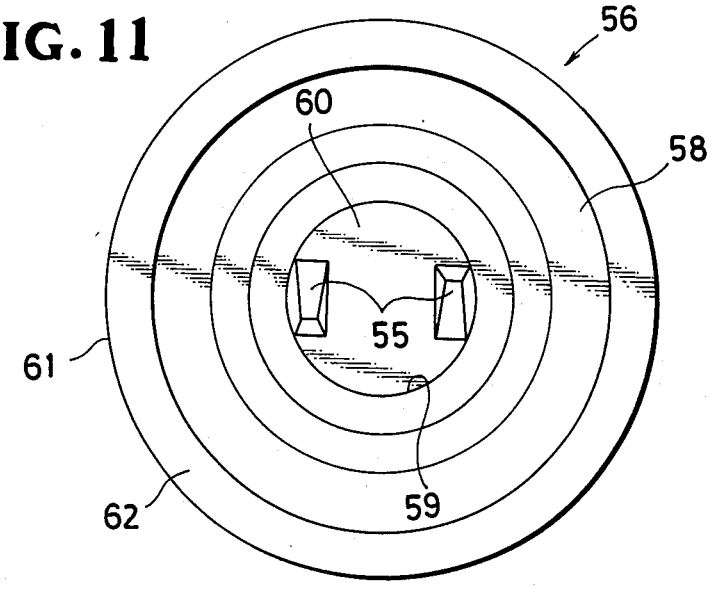
FIG. 11 is a bottom view of the fastener illustrated in FIG. 10.
Figure 12:
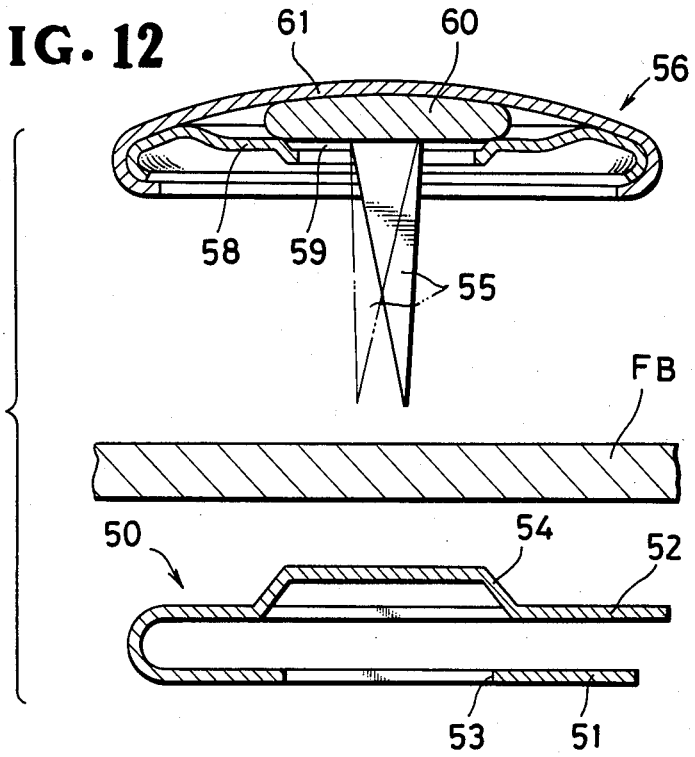
FIG. 12 is a cross-sectional view of the hook and the fastener of FIGS. 8 through 11, prior to their being coupled together on a fabric.

The eye 10 shown in FIGS. 1, 3 and 4 is used in combination with a hook 50 illustrated in FIGS. 8, 9, 12 and 13. The hook 50 is of a substantially U shape composed of a face plate 51 known as a bill and a back plate 52 spaced therefrom. The face plate 51 has a central circular hole 53 for insertion of a punch (not shown) therein. The back plate 52 has a central embossed portion 54 projecting away from the face plate 51 in substantially lateral alignment with the hole 53. The embossed portion 54 is raised from the back plate 52 by a distance slightly larger than the thickness of each of the prongs 55, 55 of a fastener 56 shown in FIGS. 10 and 11. The embossed portion 54 has a pair of spaced holes 57, 57 defined therein and divided by a bridge 49 for insertion of the prongs 55, 55, respectively, therethrough. As shown in FIGS. 10 and 11, the fastener 56 comprises a disc 58 having a central circular hole 59, a tack base 60 from which the prongs 55 project through the hole 59, and a circular cap 61 placed over the tack base 60 and having a circumferential edge 62 staked around the disc 58. The prongs 55 are tapered toward their staggered distal ends and spaced from each other by a distance which is substantially the same as the distance by which the holes 57 are spaced from each other.

Figure 13:
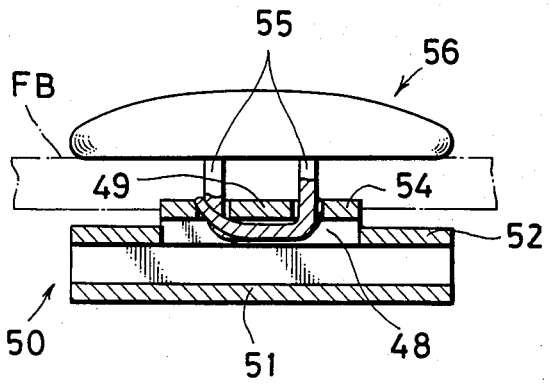
FIG. 13 is a cross-sectional view of the hook and the fastener of FIG. 12, as they are fixedly assembled on the fabric.

When the hook 50 is to be attached to a fabric FB (FIGS. 12 and 13), the hook 50 is placed below the fabric FB with the embossed portion 54 facing the fabric FB, and the fastener 56 is disposed over the fabric FB with the prongs 55, 55 directed toward the fabric FB. Then, the hook 50 and the fastener 56 are pressed toward each other by a press or the like to cause the tapered ends of the prongs 55, 55 to penerate the fabric FB and then be inserted through the holes 57, 57, respectively. Then, the prongs 55, 55 are bent by the punch inserted through the hole 53 so as to extend inwardly along each other over and around the bridge 49 to join the hook 50 firmly to the fastener 56 with the fabric FB interposed therebetween, as illustrated in FIG. 13.

The fastener 56 is securely staked on the hook 50 since the prongs 55, 55 are deformed against the bridge 49. The pointed prongs 55, 55 are not liable to pull or cut off threads of the fabric FB as the prongs 55, 55 pierce the fabric FB. The bent prongs 55, 55 have their pointed distal ends placed into the opposite holes 57, 57, as shown in FIG. 13, so that the hook 50 and the fastener 56 are securely coupled together. Since the bent prongs 55, 55 are neatly accommodated in a recess 48 in the embossed portion 54, they do not project beyond the back plate 52 toward the face plate 51 and hence do not interfere with engagement and disengagement of the hook 50 with and from the eye 10. Inasmuch as the hook 50 is fixed to the fabric FB by the two prongs 55, 55, the hook 50 will not turn with respect to the fastener 56 and the fabric FB. The hook 50 and the fastener 56 can be manufactured inexpensively by making the hook 50 of an inexpensive metal such as iron and the fastener 56 of an unoxidizable metallic material such as brass. Where the hook 50 and the fastener 56 are made of these materials, the prongs 55, 55 are not cracked when staked, and are not oxidized and remain sightly even if a plated layer comes off the prongs 55, 55.

Figure 14:
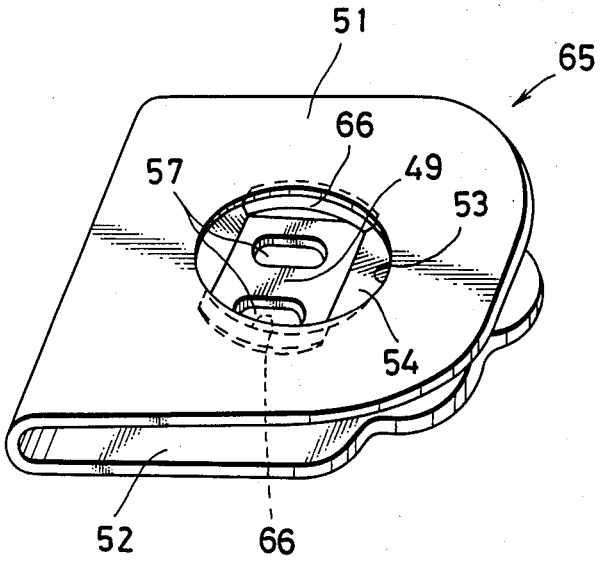
FIG. 14 is a perspective view of a modified hook.
Figure 15:
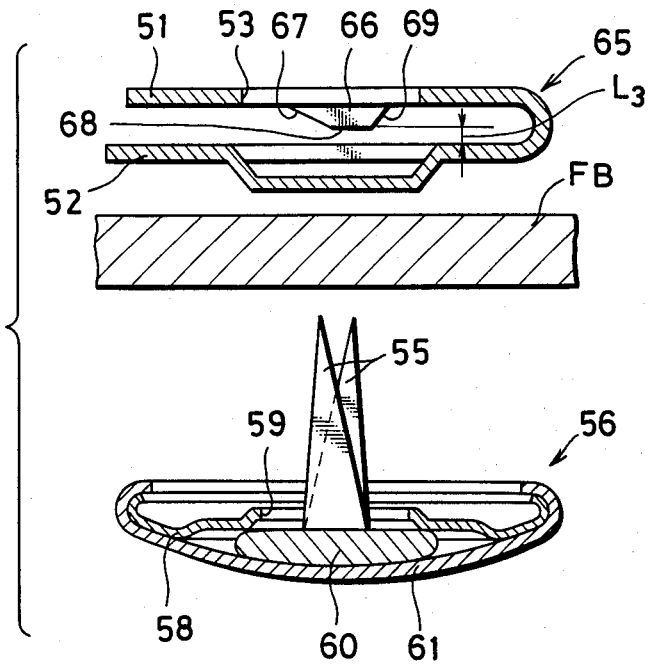
FIG. 15 is a cross-sectional view of the hook of FIG. 14, prior to its being attached to a fabric by a fastener.

FIGS. 14 and 15 show a modified hook 65 constructed for use with the eye 30 of FIGS. 5 and 6. The hook 65 is substantially the same as the hook illustrated in FIGS. 8 and 9 except that the face plate 51 has a pair of diametrically opposite ridges 66, 66 extending along peripheral edges of the circular hole 53 and projecting toward the back plate 52. Each of the ridges 66 has a front slanted edge 67 extending toward the free end of the face plate 51, a central flat edge 68 extending parallel to the back plate 52, and a rear slanted edge 69 extending toward the end of the face plate 51 which is joined to the back plate 52, the rear slanted edge 69 being steeper than the front slanted edge 67. The central flat edge 68 is spaced from the surface of the back plate 52 facing the face plate 51 by a distance $L_3$ which is substantially equal to the thickness $L_1$ of each of the flat arm portions 33 shown in FIGS. 5 and 6.

Figure 16:
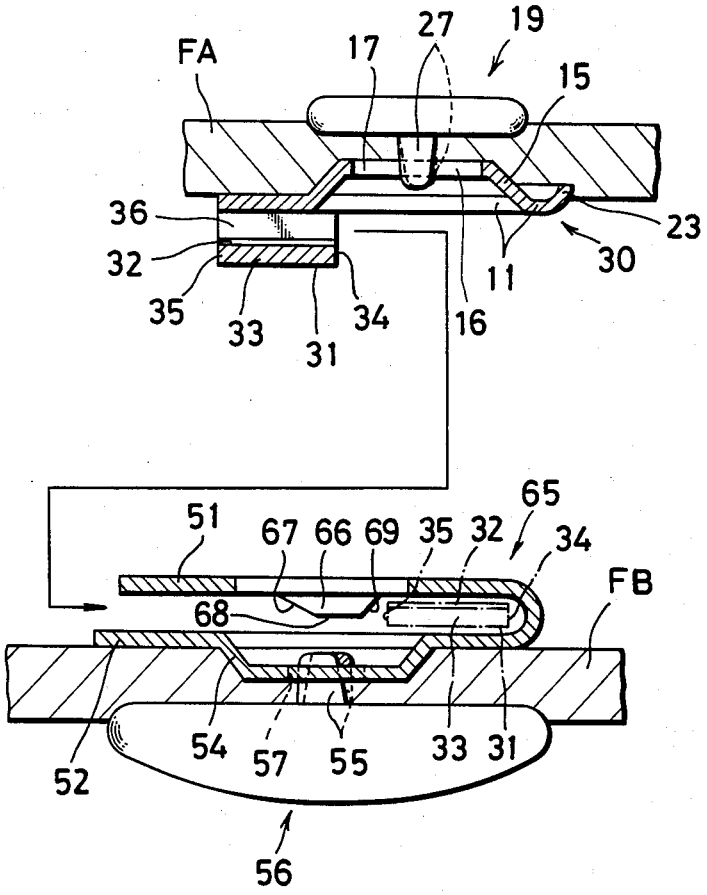
FIG. 16 is a cross-sectional view of the eye of FIG. 5 and the hook of FIG. 14, which are attached to the respective fabrics, the view showing the manner in which the eye and the hook can be joined together.

FIG. 16 shows the manner in which the hook 65 attached to the fabric FB by the fastener 56 is coupled to the eye 30 attached to the fabric FA by the fastener 19. The face plate 51 is inserted into the opening 36 in underlying relation to the base plate 11 of the eye 30 until the arms 31 are positioned deeply between the face and back plates 51, 52 of the hook 65 beyond the ridges 66. At this time, the bent edge 23 of the base plate 11 which bites into the fabric FA prevents the free end of the face plate 51 from being wedged between the fabric FA and the base plate 11. Once the hook 65 and the eye 30 are assembled together, the arms 31 are prevented by the ridges 66 from accidental removal out of the hook 65. More specifically, the pressed portions 32 are held in engagement with the ridges 66 so that the pressed portions 32 are stably positioned in the hook 65 unless a manual force is applied intentionally to remove the arms 31 out of the hook 65. Since the distance $L_3$ (FIG. 15) and the thickness $L_1$ (FIG. 6) are substantially equal to each other, the hook 65 and the eye 30 cannot easily be detached from each other after they are once assembled together. The hook 65 and the eye 30 can relatively smoothly be coupled together and disconnected from each other since the edges 34 of the arms 31 slidably engage the front and rear slanted edges 67, 69 when the arms 31 are inserted into and removed out of the hook 65. However, the edges 34 encounter a larger frictional resistance when the arms 31 are taken out of the hook 65 because of engagement with the steeper rear slanted edges 69.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A hook-and-eye assembly comprising:

(a) an eye composed a base plate having a pair of arms projecting laterally from one surface of the base plate and defining an opening therewith, said arms having confronting ends, said base plate having a first embossed portion projecting away from said arms and having a center spaced from edges of said arms, said first embossed portion having a pair of first holes divided by a first bridge;

(b) a first fastener having a pair of first prongs inserted through said first holes, respectively, and bent around said first bridge with said first embossed portion directed toward said first fastener for positioning a first fabric (FA) therebetween;

(c) a hook composed of a face plate for insertion into said opening and a back plate spaced therefrom, said back plate having a second embossed portion projecting away from said face plate and having a pair of second holes divided by a second bridge; and (d) a second fastener having a pair of second prongs inserted through said second holes, respectively, and bent around said second bridge with said second embossed portion directed toward said second fastener for positioning a second fabric (FB) therebetween.

2. A hook-and-eye assembly according to claim 1, said first embossed portion being raised from said base plate by a distance larger than the thickness of each of said first prongs, thereby defining a recess accommodating said first prongs bent around said first bridge.

3. A hook-and-eye assembly according to claim 1, said base plate having a peripheral edge bent away from said one surface thereof for biting engagement with said first fabric (FA).

4. A hook-and-eye assembly according to claim 1, said arms having a pair of pressed portions at said confronting ends thereof, said pressed portions being displaced toward said base plate, said face plate having a pair of ridges projecting toward said back plate for locking engagement with said pressed portions.

5. A hook-and-eye assembly according to claim 4, each of said pressed portions extending fully between opposite edges of one of said arms.

6. A hook-and-eye assembly according to claim 4, each of said pressed portions being disposed centrally between and terminating short of opposite edges of one of said arms.

7. A hook-and-eye assembly according to claim 4, said face plate having a central circular hole, said ridges being positioned in diametrically opposite relation to each other and extending along peripheral surfaces of said central circular hole.

8. A hook-and-eye assembly according to claim 4, said face and back plates being joined at one end thereof, each of said ridges having a first slanted edge extending away from said one end of the face and back plates, a central flat edge, and a second slanted edge extending toward said one end and steeper than said first slanted edge.

9. A hook-and-eye assembly according to claim 8, said central flat edge of each of said ridges being spaced from said back plate by a distance substantially equal to the thickness of one of said arms.

10. A hook-and-eye assembly according to claim 1, each of said first and second fasteners being made of an unoxidizable metallic material.

* * * * *